US006943500B2

(12) United States Patent
LeChevalier

(10) Patent No.: US 6,943,500 B2
(45) Date of Patent: Sep. 13, 2005

(54) MATRIX ELEMENT PRECHARGE VOLTAGE ADJUSTING APPARATUS AND METHOD

(75) Inventor: Robert LeChevalier, Golden, CO (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 257 days.

(21) Appl. No.: 10/274,489

(22) Filed: Oct. 17, 2002

(65) Prior Publication Data

US 2003/0173904 A1 Sep. 18, 2003

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,791, filed on Oct. 19, 2001, provisional application No. 60/343,370, filed on Oct. 19, 2001, provisional application No. 60/342,783, filed on Oct. 19, 2001, and provisional application No. 60/342,794, filed on Oct. 19, 2001.

(51) Int. Cl.[7] ..... G09G 3/10; G09G 3/30

(52) U.S. Cl. ..... 315/169.3; 315/169.4; 345/77; 345/76; 345/90

(58) Field of Search ..... 315/169.1–169.4; 345/74–77, 90–92, 55, 63, 84

(56) References Cited

U.S. PATENT DOCUMENTS

| | | | |
|---|---|---|---|
| 4,366,504 A | 12/1982 | Kanatani | 358/241 |
| 4,603,269 A | 7/1986 | Hochstein | 307/571 |
| RE32,526 E | 10/1987 | Hochstein | 307/571 |
| 4,823,121 A | 4/1989 | Sakamoto et al. | 340/781 |
| 5,117,426 A | 5/1992 | McAdams | 371/214 |

(Continued)

FOREIGN PATENT DOCUMENTS

| | | |
|---|---|---|
| EP | 0 678 849 A1 | 10/1995 |
| EP | 1 071 070 A2 | 1/2001 |
| EP | 1 081 836 A2 | 3/2001 |
| EP | 1 071 070 A3 | 1/2002 |
| GB | 2 337 354 A | 11/1999 |
| GB | 2 339 638 A | 2/2000 |
| JP | 59-97223 | 6/1984 |
| JP | 4-172963 | 6/1992 |
| JP | 07-199861 | 8/1995 |
| JP | 7-322605 | 12/1995 |
| JP | 11-330376 | 11/1999 |
| WO | WO 01/27910 A1 | 4/2001 |

OTHER PUBLICATIONS

International Search Report dated Apr. 8, 2004 for International Application No. PCT/US02/33373.

International Search Report for International Application No. PCT/US02/33426, filed Oct. 17, 2002, dated Jun. 23, 2003.

International Search Report dated Jun. 26, 2003 for International Application No. PCT/US02/33364, filed Oct. 17, 2002.

(Continued)

*Primary Examiner*—Tuyet Thi Vo
(74) *Attorney, Agent, or Firm*—Knobbe, Martens, Olson & Bear, LLP

(57) ABSTRACT

An apparatus for establishing and applying a voltage to precharge current-driven elements in a matrix. During ordinary scan cycles, a conduction voltage is sensed while the elements conduct a selected current. One or more such sensed conduction voltages are combined to provide a basis for a precharge voltage. Conduction and transient errors are determined, and are compensated for by offsetting the final precharge voltage from the conduction voltage basis. The final precharge voltage is provided to one or more columns during a precharge period of the scan cycle.

51 Claims, 6 Drawing Sheets

U.S. PATENT DOCUMENTS

| | | | | | |
|---|---|---|---|---|---|
| 5,162,688 | A | | 11/1992 | Bouton | 310/239 |
| 5,514,995 | A | | 5/1996 | Hennig | 327/399 |
| 5,519,712 | A | | 5/1996 | Shu et al. | 365/201 |
| 5,594,463 | A | * | 1/1997 | Sakamoto | 345/76 |
| 5,606,527 | A | | 2/1997 | Kwack et al. | 365/201 |
| 5,672,992 | A | | 9/1997 | Nadd | 327/390 |
| 5,689,208 | A | | 11/1997 | Nadd | 327/390 |
| 5,764,207 | A | | 6/1998 | Maekawa et al. | 345/99 |
| 5,818,268 | A | | 10/1998 | Kim et al. | 327/77 |
| 5,844,368 | A | | 12/1998 | Okuda et al. | 315/169.3 |
| 5,949,194 | A | * | 9/1999 | Kawakami et al. | 315/169.4 |
| 5,952,789 | A | | 9/1999 | Stewart et al. | 315/169.4 |
| 6,075,739 | A | | 6/2000 | Ihara | 365/222 |
| 6,067,061 | A | * | 7/2000 | Friedman | 345/74.1 |
| 6,181,314 | B1 | * | 1/2001 | Nakajima et al. | 345/100 |
| 6,191,534 | B1 | | 2/2001 | Schuler et al. | 315/169.3 |
| 6,201,717 | B1 | | 3/2001 | Grant | 363/60 |
| 6,229,508 | B1 | * | 5/2001 | Kane | 345/82 |
| 6,448,948 | B1 | | 9/2002 | Friedman | 345/74 |
| 6,583,775 | B1 | | 6/2003 | Sekiya et al. | 345/76 |
| 6,584,589 | B1 | | 6/2003 | Pemer et al. | 714/721 |
| 6,594,606 | B2 | * | 7/2003 | Everitt | 702/107 |
| 2001/0024186 | A1 | | 9/2001 | Kane et al. | 345/98 |

OTHER PUBLICATIONS

International Search Report dated Jun. 26, 2003 for International Application No. PCT/US02/33428, filed Oct. 17, 2002.

International Search Report dated Jun. 26, 2003 for International Application No. PCT/US02/33519, filed Oct. 17, 2002.

International Search Report dated Nov. 27, 2003 for International Application No. PCT/US02/14699, filed May 7, 2002.

International Search Report dated Nov. 28, 2003 for International Application No. PCT/US02/14686, filed May 7, 2002.

International Search Report for International Application No. PCT/US02/33375, filed Oct. 17, 2002, dated Jun. 23, 2002.

International Search Report for International Application No. PCT/US02/33574, filed Oct. 17, 2002, dated Jun. 23, 2002.

* cited by examiner

MATRIX ELEMENT PRECHARGE VOLTAGE ADJUSTING APPARATUS AND METHOD

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001, entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES";

U.S. patent application entitled "CURRENT BALANCING CIRCUIT", filed May 7, 2002;

U.S. patent application entitled "CURRENT BALANCING CIRCUIT", filed May 7, 2002;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141659, filed on May 7, 2002, entitled "MATCHING SCHEME FOR CURRENT CONTROL IN SEPARATE I.C.S.";

U.S. patent application Ser. No. 10/141326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. patent application entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith;

U.S. patent application entitled "METHOD AND SYSTEM FOR CHARGE PUMP ACTIVE GATE DRIVE", filed on even date herewith;

U.S. patent application entitled "METHOD AND CLAMPING APPARATUS FOR SECURING A MINIMUM REFERENCE VOLTAGE IN A VIDEO DISPLAY BOOST REGULATOR", filed on even date herewith;

U.S. patent application Ser. No. 10/141,648, filed May 7, 2002, entitled "APPARATUS FOR PERIODIC ELEMENT VOLTAGE SENSING TO CONTROL PRECHARGE";

U.S. patent application Ser. No. 10/141,318, filed May 7, 2002, entitled "METHOD FOR PERIODIC ELEMENT VOLTAGE SENSING TO CONTROL PRECHARGE,";

U.S. patent application entitled "SYSTEM AND METHOD FOR EXPOSURE TIMING COMPENSATION FOR ROW RESISTANCE", filed on even date herewith;

U.S. patent application entitled "METHOD AND SYSTEM FOR PRECHARGING OLED/PLED DISPLAYS WITH A PRECHARGE LATENCY", filed on even date herewith;

U.S. Provisional Application No. 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. patent application entitled "ADAPTIVE CONTROL BOOST CURRENT METHOD AND APPARATUS", filed on even date herewith;

U.S. patent application entitled "PREDICTIVE CONTROL BOOST CURRENT METHOD AND APPARATUS", filed on even date herewith;

U.S. patent application entitled "RAMP CONTROL BOOST CURRENT METHOD", filed on even date herewith;

U.S. patent application entitled "METHOD AND SYSTEM FOR ADJUSTING PRECHARGE FOR CONSISTENT EXPOSURE VOLTAGE", filed on even date herewith;

U.S. patent application entitled "METHOD AND SYSTEM FOR RAMP CONTROL OF PRECHARGE VOLTAGE", filed on even date herewith.

BACKGROUND OF THE INVENTION

1. Field of the Invention

This invention generally relates to electrical drivers for a matrix of current driven devices, and more particularly to methods and apparatus for determining and providing a precharge voltage for such devices.

2. Description of the Related Art

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements which luminesce when excited by current flow. A common luminescent device for such displays is a light emitting diode (LED).

LED arrays produce their own light in response to current flowing through the individual elements of the array. The current flow may be induced by either a voltage source or a current source. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, they may be similarly arranged in a 2 dimensional array (matrix) of elements to form a display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified.

FIG. 1A is an exploded view of a typical physical structure of such a passive-matrix display 100 of OLEDs. A layer 110 having a representative series of rows, such as parallel conductors 111–118, is disposed on one side of a sheet of light emitting polymer, or other emissive material, 120. A representative series of columns are shown as parallel transparent conductors 131–138, which are disposed on the other side of sheet 120, adjacent to a glass plate 140. FIG. 1B is a cross-section of the display 100, and shows a drive voltage V applied between a row 111 and a column 134. A portion of the sheet 120 disposed between the row 111 and the column 134 forms an element 150 which behaves like an LED. The potential developed across this LED causes current flow, so the LED emits light 170. Since the emitted light 170 must pass through the column conductor 134, such column conductors are transparent. Most such transparent conductors have relatively high resistance compared with the row conductors 111–118, which may be formed from opaque materials, such as copper, having a low resistivity.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied. Exactly one device is common to both a particular row and a particular column, so to control these individual LED devices located at the matrix junctions it is useful to have two distinct drive circuits, one to drive the column and one to drive the row. It is conventional to sequentially scan the rows (conventionally connected to device cathodes) with a driver switch to a known voltage such as ground, and to provide another driver, which may be a current source, to drive the columns (which are conventionally connected to device anodes).

FIG. 2 represents such a conventional arrangement for driving a display having M rows and N columns. A column driver device 260 includes one column drive circuit (e.g. 262, 264, 266) for each column. The column drive circuit 264 shows some of the details which are typically provided in each column drive circuit, including a current source 270 and a switch 272 which enables a column connection 274 to be connected to either the current source 270 to illuminate the selected diode, or to ground to turn off the selected diode. A scan circuit 250 includes representations of row driver switches (208, 218, 228, 238 and 248). A luminescent display 280 represents a display having M rows and N columns, though only five representative rows and three representative columns are drawn.

The rows of FIG. 2 are typically a series of parallel connection lines traversing the back of a polymer, organic or other luminescent sheet, and the columns are a second series of connection lines perpendicular to the rows and traversing the front of such sheet, as shown in FIG. 1A. Luminescent elements are established at each region where a row and a column overlie each other so as to form connections on either side of the element. FIG. 2 represents each element as including both an LED aspect (indicated by a diode schematic symbol) and a parasitic capacitor aspect (indicated by a capacitor symbol labeled "CP").

In operation, information is transferred to the matrix display by scanning each row in sequence. During each row scan period, each column connected to an element intended to emit light is also driven. For example, in FIG. 2 a row switch 228 grounds the row to which the cathodes of elements 222, 224 and 226 are connected during a scan of Row K. The column drive switch 272 connects the column connection 274 to the current source 270, such that the element 224 is provided with current. Each of the other columns 1 to N may also be providing current to the respective elements connected to Row K at this time, such as the elements 222 or 226. All current sources are typically at the same amplitude. OLED element light output is controlled by controlling the amount of time the current source for the particular column is on. When an OLED element has completed outputting light, its anode is pulled to ground to turn off the element. At the end of the scan period for Row K, the row switch 228 will typically disconnect Row K from ground and apply Vdd instead. Then, the scan of the next row will begin, with row switch 238 connecting the row to ground, and the appropriate column drive circuits supplying current to the desired elements, e.g. 232, 234 and/or 236.

Only one element (e.g. element 224) of a particular column (e.g. column J) is connected to each row (e.g. Row K), and hence only that element of the column is connected to both the particular column drive (264) and row drive (228) so as to conduct current and luminesce (or be "exposed") during the scan of that row. However, each of the other devices on that particular column (e.g. elements 204, 214, 234 and 244 as shown, but typically including many other devices) are connected by the driver for their respective row (208, 218, 238 and 248 respectively) to a voltage source, Vdd. Therefore, the parasitic capacitance of each of the devices of the column is effectively in parallel with, or added to, the capacitance of the element being driven. The combined parasitic capacitance of the column limits the slew rate of a current drive such as drive 270 of column J. Nonetheless, rapid driving of the elements is necessary. All rows must be scanned many times per second to obtain a reasonable visual appearance, which permits very little time for conduction for each row. Low slew rates may cause large exposure errors for short exposure periods. Thus, for practical implementations of display drivers using the prior art scheme, the parasitic capacitance of the columns may be a severe limitation on drive accuracy.

A luminescent device matrix and drive system as shown in FIG. 2 is described, for example, in U.S. Pat. No. 5,844,368 (Okuda et al.). To mitigate the effects of parasitic capacitances, Okuda suggests, for example, resetting each element between scans by applying either ground or Vcc (10V) to both sides of each element at the end of each exposure period. To initiate scanning a row, Okuda suggests conventionally connecting all unscanned rows to Vcc, and grounding the scanned row. An element being driven by a selected column line is therefore provided current from the parasitic capacitance of each element of the column line which is attached to an unscanned row. The Okuda patent does not reveal any means to establish the correct voltage for a selected element at the moment of turn-on. In many applications the voltage required for display elements at a given current will vary as a function of display manufacturing variations, display aging and ambient temperature, and Okuda also fails to provide any means to compensate for such variation.

In view of the above, it may be appreciated that there is a need for a precharge process to reduce the substantial errors in OLED current which may result from employing a current drive for rapid scanning of OLED devices in a matrix having a large parasitic capacitance. Moreover, since the voltage for an OLED varies substantially with temperature, process, and display aging, a need may also be appreciated to monitor the "on" voltage of the OLEDs and change the precharge process accordingly. Thus, what is needed in this industry is a means to determine and apply correct voltages at the beginning of scans of current-driven devices in an array.

SUMMARY OF THE INVENTION

In response to the needs discussed above, an apparatus is presented for providing an improved precharge, including a feature to measure or sample a conduction voltage, and a feature which provides a precharge which has been appropriately offset from a reference reflecting the conduction voltage. The invention may be embodied a number of ways.

One embodiment which may provide a precharge voltage includes a current source configured to provide a controlled current to a selected display element, and a sample circuit configured to obtain a display conduction voltage sample which substantially reflects an output voltage caused by conduction of the controlled current at least partly through the selected display element. This embodiment further includes a storage device to hold a representation of a reference voltage which is based on the display conduction voltage, and a precharge voltage source configured to output a voltage reflecting the reference representation of output voltage as offset by a quantity selected to compensate for expected transient voltage effects.

Another embodiment may be used for driving conduction lines connected to a matrix. This embodiment includes a current source switchably connected to a conduction line during a conduction period of a matrix element, and a voltage sampling circuit configured to sample a voltage of the conduction line during the conduction period. A combining circuit is included which is configured to determine a conduction line voltage level from a combination of one or more conduction line voltage samples, as well as a precharge basis storage circuit which is configured to obtain a precharge basis which is based upon the determined conduction line voltage level, and to store a representation of the precharge basis. This embodiment also includes a precharge voltage source configured to provide a precharge voltage based upon the stored representation of precharge basis, an offset circuit configured to offset the precharge voltage from the determined conduction line voltage level, and as is an offset circuit configured to offset the precharge voltage level from the determined conduction line voltage level, and a switch which is controllable to connect the provided precharge voltage to an element conduction line during a precharge period.

A further embodiment may provide a precharge for elements in a matrix, and includes a plurality of controlled level current sources which are switchably connectable to a corresponding plurality of column connections. This embodiment includes a sample circuit configured to obtain a column connection voltage sample while the corresponding current source is connected to the column connection, and a storage device configured to store a reference voltage based at least in part on the column connection voltage sample. It also includes a precharge voltage source which is connectable during a precharge period to at least one column connection, so as to provide a precharge voltage which is offset from the reference voltage by a predetermined compensation voltage.

Yet another embodiment may provide a precharge to display elements, and includes means for providing a known current to a selected display element, and means for obtaining a display conduction voltage which is caused by conduction of the known current at least partly by the selected display element. This embodiment further includes means for storing a reference voltage which is based on the display conduction voltage, and means for outputting a precharge voltage substantially equal to the reference voltage as offset by an amount which is selected to compensate for differences between the output precharge voltage and the display conduction voltage which are expected due to connection changes associated with changing from a precharge state to a conduction state.

One aspect of the invention concerns a method for establishing a precharge voltage for current-driven device elements in a matrix. The method comprises selecting an element for sampling, and driving a controlled current from a current source into a connection to the selected element via a current drive path. The method further comprises producing a conduction voltage sample by sampling a voltage which substantially reflects a voltage caused by the selected element conducting at least part of the controlled current. The method may also comprise generating an offset voltage to compensate for perturbations to a delivered voltage which are expected for a subsequently driven element. The method may also include combining the offset voltage with one or more conduction voltage samples to obtain an adjusted precharge voltage level. The method may further comprise generating a precharge voltage source output substantially at the adjusted precharge voltage level, and precharging the subsequently driven element from the precharge voltage source during a precharge period.

In one embodiment, the invention is directed to a method for adjusting a precharge voltage for current-driven device elements in a matrix. The method comprises selecting an element for sampling, and applying the precharge voltage to a connection to the element during a precharge period of a scan cycle. The method further comprises driving a selected current from a current source to the connection to the element during a current conduction period of the scan cycle, and sampling a conduction voltage during the current conduction period of the scan cycle. The method may also comprise adjusting the precharge voltage based at least in part on the sampled conduction voltage.

Another feature of the invention is related to a method of manufacturing an electronic display device. The method comprises obtaining a matrix device column driver configured to sample a voltage of a column drive output during a conduction period of an exposure cycle to obtain an exposure conduction sample voltage. The method may also comprise provide, to a column drive output, a precharge voltage which is offset from a precharge voltage basis derived in part from the exposure conduction sample voltage, the offset being selected to compensate for expected deviations between a delivered precharge voltage and a voltage of a column drive output following termination of the precharge voltage provision. The method may also further include connecting a plurality of column drive outputs of the matrix device column driver to corresponding column connections of a luminescent display. The method may further comprise connecting a plurality of row connections of the luminescent display to a corresponding plurality of row drive outputs of an electronic row driver device which is configured to selectively connect one of the plurality of row drive outputs to a row drive voltage during the exposure time of the matrix device column driver.

Yet another aspect of the invention is related to a method of manufacturing a device for driving a multiplicity of output conduction lines when they are connected to matrix display elements. The method comprises switchably connecting a corresponding electronic current source to each of the output conduction lines, and emplacing control logic devices to selectably connect one of the current sources to its corresponding output conduction line during a conduction period. The method further comprises disposing a voltage sampling circuit in the device which is configured to sample a voltage of the conduction line during the conduction period, and connecting a combining circuit to the device configured to determine a basis for a precharge voltage from a combination of one or more conduction line voltage samples. The method may also comprise incorporating a controllable offset circuit in the device, and providing a precharge voltage source buffer in the device configured to produce a precharge voltage which is offset from the precharge voltage basis in accordance with an offset from the offset circuit.

Yet another aspect of the invention concerns a method for establishing a precharge voltage for current-driven device elements in a matrix. The method comprises driving a selected current from a current source to a selected matrix element via a current drive path, and generating a conduction voltage reference value reflecting a conduction voltage of the current drive path. The method further comprises offsetting the conduction voltage reference value with a selected voltage offset value to compensate for expected differences between a delivered precharge voltage and a voltage occurring during subsequent conduction by the device element. The method may also include outputting a precharge voltage substantially at the offset conduction voltage reference value during a precharge period.

BRIEF DESCRIPTION OF THE DRAWINGS

The foregoing and other features and objects of the invention will become more fully apparent from the following description and appended claims taken in conjunction with the following drawings, in which like reference numbers indicate identical or functionally similar elements.

DETAILED DESCRIPTION OF THE PREFERRED EMBODIMENT

The embodiments described below overcome obstacles to the accurate generation of a desired amount of light emission from an LED display, particularly in view of impediments which are rather pronounced in OLEDs, such as relatively high parasitic capacitances, and forward voltages which vary with time and temperature. However, the invention is more general than the embodiments which are explicitly described, and is not to be limited by the specific embodiments but rather is defined by the appended claims. In particular, the invention may be applied to enhance the accuracy of current delivered to any matrix of current-driven devices.

Normal Display Drive

Figure 1B:
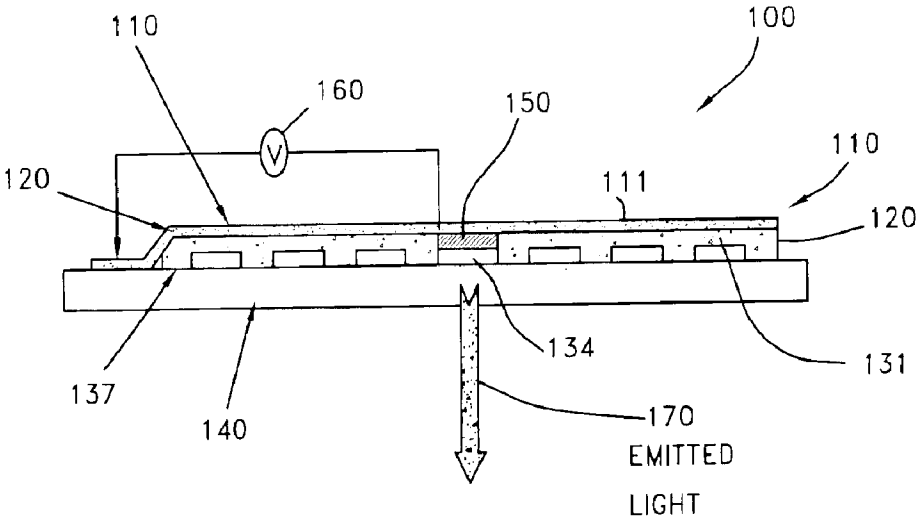
PRIOR ART FIG. 1B
FIG. 1B is a cross-sectional view of the OLED display of FIG. 1A.
Figure 1A:
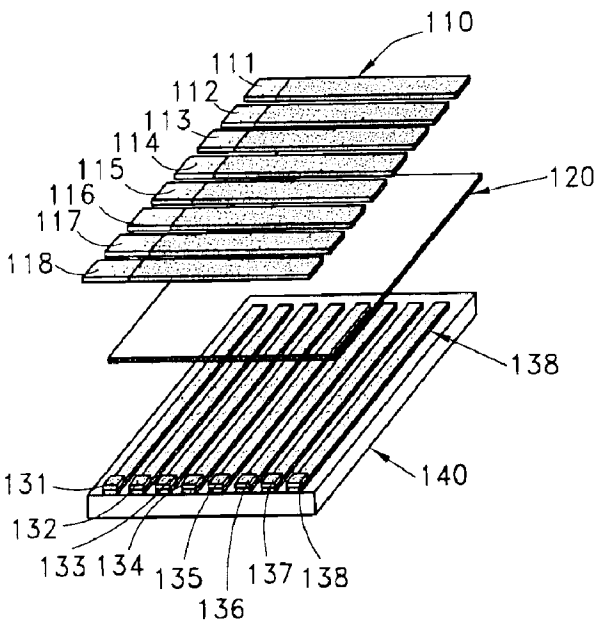
PRIOR ART FIG. 1A
FIG. 1A is a simplified exploded view of an OLED display.
Figure 2:
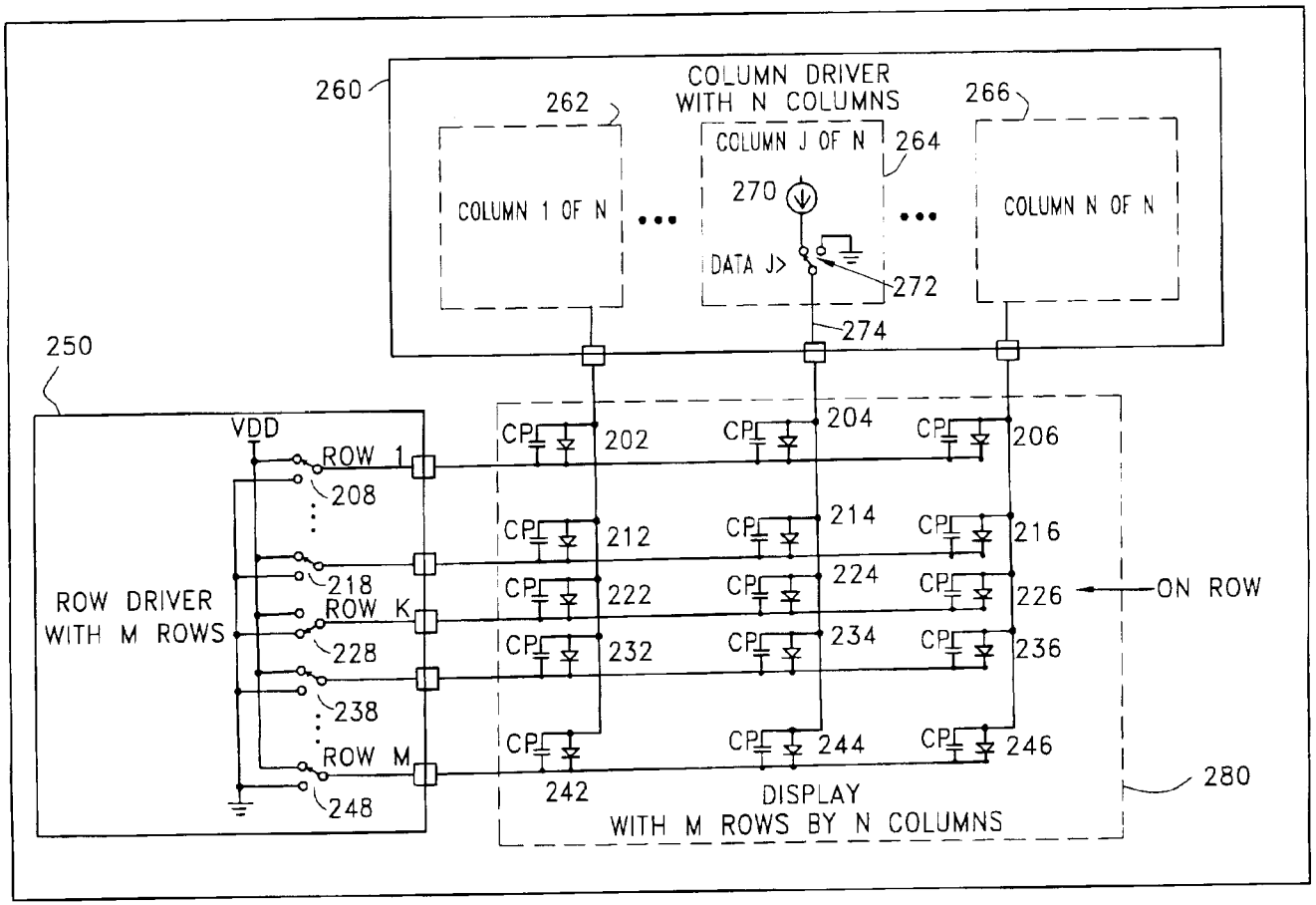
FIG. 2 is a schematic diagram of an OLED display with column and row drivers.

Referring again to FIG. 2, further details are shown of a passive current-device matrix and drive system as used with embodiments described herein. Current sources such as the current source 270 are typically used to drive a predetermined current through a selected pixel element such as the element 224. However, applied current will not flow through any OLED element until the column's parasitic capacitance is first charged to a voltage at which the OLED element can conduct. When the row switch 228 is connected to ground to scan Row K, the entire column connection 274 must reach a requisite voltage in order to drive the desired current in element 224. The requisite voltage may be, for example, about 6V, and is a characteristic value of the pixel element which varies as a function of current, temperature, and time. The voltage on the column connection 274 will move from a starting value toward a steady-state value, but not faster than the current source 270 can charge the combined capacitance of all of the parasitic capacitances of the elements connected to the column connection 274. In one display, for example, there may be 96 rows, and thus 96 devices connected to each column 274. Each device may have a typical parasitic capacitance value of about 25 pF, for a total column parasitic capacitance of 2400 pF (96×25 pF). A typical value of current from current source 270 is 100 $\mu$A. Under these circumstances, the voltage will not rise faster than about 100 $\mu$A/(96×25 pF), or 1/24 V/$\mu$S, and will change even more slowly as the LED begins to conduct significantly. The result is that the current through the LED (as opposed to the current through the parasitic capacitance) will rise very slowly, and may not achieve the target current by the end of the scan period if the column voltage starts at a low value. For example, if an exemplary display having 96 rows operates at 150 frames per second, then each scan has a duration of not more than 1/150/96 seconds, or less than about 70 $\mu$S. At a typical 100 $\mu$A drive current the voltage can charge at only about 1/24 V/$\mu$S, or 42 mV per $\mu$S (when current begins to flow in the OLED, this charging rate will fall off). At 1/24 V/$\mu$S, the voltage would rise by no more than about 2.9 V during the scan period, which would not even bring a column voltage (Vcol) from 0 to a nominal conduction voltage of 6V.

Since the current source 270, alone, will be unable to bring an OLED from zero volts to operating voltage during the entire scan period in the circumstance described above, a distinct "precharge" period may be set aside during which the voltage on each device is driven to a precharge voltage value Vpr. Vpr is ideally the voltage which causes the OLED to achieve, at the beginning of its exposure period, the voltage which it would develop at equilibrium when conducting the selected current. The precharge is preferably provided at a relatively low impedance in order to minimize the time needed to achieve Vpr.

Figure 3:
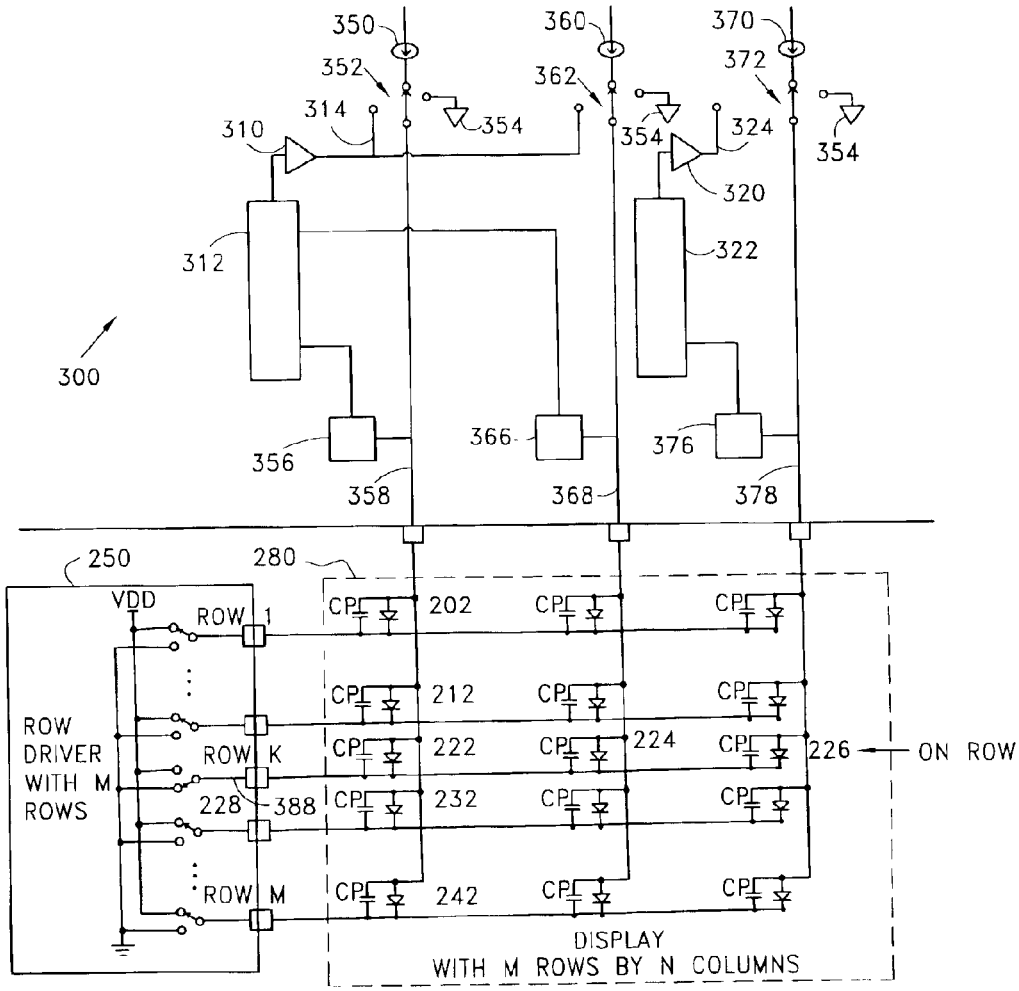
FIG. 3 is a schematic representation of elements for determining a precharge voltage.

FIG. 3 schematically illustrates a circuit configuration for control and sampling of the voltage at representative column connections 358, 368 and 378. For each column connection, a switch 352, 362 or 372 connects the column to various sources at appropriate times. For example, during a precharge period, each of the switches 352, 362 and 372 will connect the column to a precharge voltage source output, such as 314 or 324. The figure is shown during an exposure period, when a row switch such as 228 connects a row (K) to a drive voltage, and when each column switch 352, 362 and 372 connects each column (if active) to the corresponding current source 350, 360 and 370. At the end of each column exposure period, the length of which may vary between columns, the corresponding column switch (e.g. 352) may connect the column to a column discharge potential 354. The column discharge potential may be ground, or another potential which is low enough to ensure rapid turn-off of the active elements.

Obtaining a Precharge Voltage

FIG. 3 illustrates, with a simplified schematic, how the precharge voltage may be obtained. First, a device conduction voltage may be sampled to obtain a conduction sample voltage Vcs. Column voltages referenced to ground, Vcol, which are available in the driver device 300 at column connections such as 358, 368 and 378, are good examples of such conduction voltages. Accordingly, in the present description Vcs is often a sample of Vcol, but it should be understood that in many embodiments Vcs may be a sample of an alternative voltage, as is discussed subsequently. One or more such Vcs quantities may be used to affect or control the precharge voltage.

The voltage Vcol of any of the column connections, e.g. 358, 368 and 378, may be sampled by a sampling circuit 356, 366 or 376 respectively, to obtain a Vcs for the column. Vcol for the column connection 358, for example, includes the voltage produced on an element 222 (shown with both diode aspect and parasitic capacitance aspect "CP"), as driven by a current source 350 in a column driver device 300. The cathode side of the element 222 is connected to ground through the row driver switch 228. Vcol of the column connection 358 further includes a potential induced by the current provided by the current source 350, multiplied by that portion of a resistance of the column trace which exists between the connection 358 and the element 222. Moreover, that Vcol includes the voltage produced by the common row impedance of the display 280 between the element 222 and a row K connection 388, as well as the driver impedance from the row K connection 388, through the switch 228, to ground, due to combined currents from the element 222 and any other conducting elements, e.g. 224 and 226. Thus, the Vcs from Vcol of the column connection 358 reflects other conduction voltages as well as the voltage developed across the element 222 by the column current source 350. A Vcs may similarly be obtained corresponding to any other column connection.

Column voltages Vcol, such as will be present at column connections such as 358, 368 and 378, are particularly described herein both to be sampled to obtain a Vcs and ultimately a precharge voltage Vpr, and also to be set by precharging. However, for some circumstances it will be useful to sample and/or control other conduction voltages which occur in the matrix element current paths. For example, a column-to-row voltage between column connections (e.g. 358) and row connections (e.g. 388) may be sampled, particularly if the row driver device 250 is packaged together with the column driver device 300. Such sampling may eliminate some variability in Vcs which is not due to a voltage developed across an element. Similarly, controlling the column-to-row voltages may more closely establish the desired matrix element voltages.

One or more Vcs samples, obtained as described above, will be employed to affect or control a precharge voltage. For example, the Vcs from the sample device 376 may be transferred directly to a hold device 322, and thence applied directly to a buffer 320 which provides a precharge voltage output 324 for precharging the column through the switch 372. If the sample device 376 provides a digital representation, then the hold device 322 may receive and convert such digital representation to a voltage to input to the buffer device 320. The same effect may be provided analogically if the hold device 322 buffers the Vcs from the sample device 376, and charges a hold capacitor in the hold device 322 to a hold voltage Vh which directly controls the buffer 320.

More than one Vcs may be combined to control a precharge voltage. For example, the hold device 322 may combine an incoming Vcs with previous Vcs voltages to obtain a smoothed hold voltage Vh to apply to the buffer 320. As another example, a hold device 312 may combine Vcs from sample devices, e.g. 356 and 366, to provide an input to a buffer 310 for providing a precharge voltage 314. The hold circuit 312 may combine not only the different Vcs inputs with each other, but with previous voltages as well. As shown, the precharge voltage 314 output from the buffer 310 is provided, via a respective switch 352 or 362, to the same columns which provide the source for the Vcs upon which the precharge voltage is based. However, it should be noted that many other columns may be, precharged with a particular precharge voltage, e.g. 314, derived from a limited number of columns such as 358 and 368.

Either (or both) digital or analog storage and combination techniques may be used to derive and store a precharge basis which reflects previous Vcs values, and precharge voltages may then be based on the precharge basis. If the sample devices 356, 366 and 376 are ADCs providing a digital output, then the hold devices 312 and 322 (or buffers 310 and 320) will typically include a DAC to convert the outputs from the sample devices into analog form, with or without further adjustment of the values, to set the precharge voltage level. Such digital embodiments are well known in the art, and can be provided by the skilled person. An example of an analog embodiment for combining and storing Vcs values to provide precharge voltage is illustrated in FIG. 4.

Figure 4:
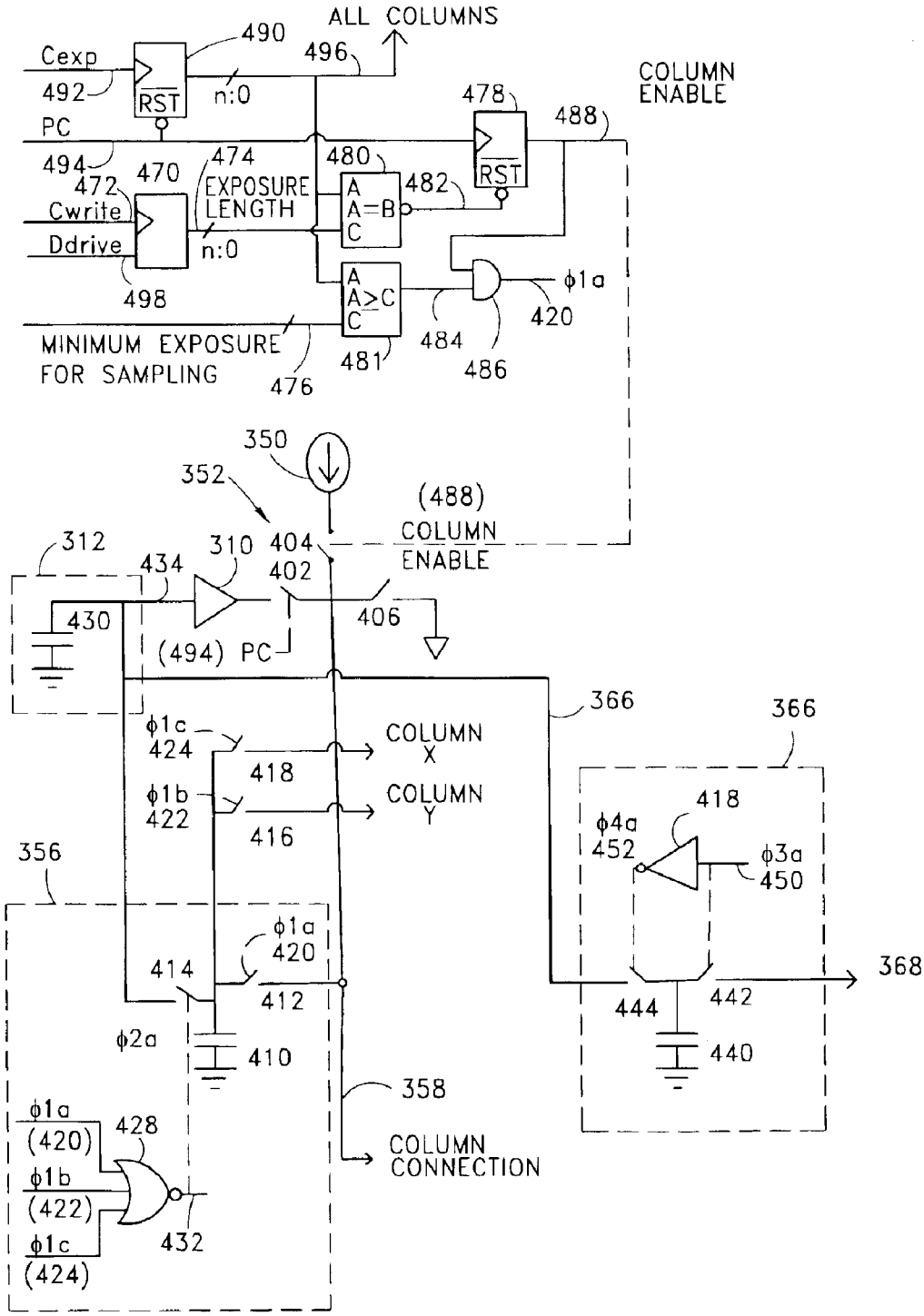
FIG. 4 is a simplified schematic diagram of circuit details for determining a precharge voltage and setting an element exposure length.

FIG. 4 is a simplified, representative schematic of some aspects of an analog device embodiment of a column driver such as the driver device 300 of FIG. 3. One simplification represents electronic switches by a mechanical switch symbol, with a dotted line to a signal controlling the switch. A true (e.g., "1") value of the control logic closes the switch. The mechanical representation of the switch may imply some logic to preclude overlapping connections in a multiple-throw switch, such as the switch 352. The level shifting and logic needed to cause such electronic switches to function in accordance with the mechanical representation are well known in the art, and will be readily implemented by the skilled person.

FIG. 4 illustrates, with sample circuits 356 and 366, two techniques for sampling a variety of column voltages. Sample circuit 366 illustrates use of a single sample circuit 366 with a corresponding single column connection 368. An alternative technique is illustrated with respect to sample circuit 356. With the inclusion of logic such as the NOR gate 428, and extra sample switches such as 416 and 418 to connect to other columns X or Y, sample circuit 356 in FIG. 4 shows additional details (beyond those in FIG. 3) whereby several different columns, such as X, Y and the column connection 358, may be selectably sampled by the single sample device 356 in a manner which is not explicitly shown in FIG. 3. FIG. 4 thus illustrates an embodiment in which both techniques are used with different columns, but, of course, a given design may utilize only the technique illustrated with the sample circuit 356, or only the technique illustrated with the sample circuit 366.

In the technique illustrated with sample circuit 366, each separate sample capacitor 440 is connected via a switch 442 to just one column connection 368 under control of a sample switch control signal $\Phi 3a$ 450. A sample output switch 444 may be provided to connect the sample capacitor 440 to the hold device 312 under control of a second phase control signal $\Phi 4a$ 452, which may be true whenever $\Phi 3a$ is not true, as represented by an inverter 446. $\Phi 3a$ and $\Phi 4a$ may in general be false at the same time.

In the technique illustrated with sample device 356, a sample capacitor 410 may be used for sampling voltage on a variety of column connections. A sample output switch 414 may also be provided to connect the sample capacitor 410 to the hold device 312. The output switch 414 is controlled by a second phase logic signal $\Phi 2a$ 432, and will typically be open whenever another switch is closed to the sample device 356, particularly input switches such as 412, 416 and 418. Thus, when the sample capacitor 410 in the sample device 356 includes switches such as 416 or 418 to sample extra columns Y or X, as shown, the control signal $\Phi 2a$ 432 of the switch 414 is preferably true only when all of the sample switch control signals $\Phi 1a$ 420, $\Phi 1b$ 422 and $\Phi 1c$ 424 are false. The representative NOR gate 428 implementing this function preferably includes non-overlap logic, such that the switches connected to the sample capacitor 410 are closed only at mutually exclusively times.

The hold device 312 is shown as including a hold capacitor 430, and provides an output hold voltage Vh at a hold output connection 434 which is connected to the buffer 310. The hold device 312 may accept inputs from a number of sample circuits, as shown, via the sample output switch 414 for the Vcs on the sample device 356, and via the sample output switch 444 for the Vcs on the sample capacitor 440. More such sample devices may also be connected. Thus, present values from sample circuits such as 356 and 366 may be combined with each other, and/or combined with previous Vcs values, to achieve a hold voltage Vh at connection 434 for input to the precharge voltage buffer 310 to provide a precharge voltage Vpr for one or more corresponding columns. Previous values of Vcs are typically combined in a Vh, but if temporal averaging is not desired then it may be avoided, for example, by making the hold capacitor 430 small compared to the sum of sample capacitors (e.g., 410 and 440) which are connected to it. The sample output switches, such as 414 and 444, which provide switchable connection of any number of sample devices to a hold device such as 312, may typically be closed simultaneously.

Particular embodiments may also employ just a single sample device, such as the sample device 356, with a particular hold device such as 312, in which case combining different sample values is not necessary. Such an embodiment may be convenient when all columns to be sampled for determining the precharge voltage from a particular buffer (such as the buffer 310) are switchably connected to the single sample device (e.g., via switches such as 412, 416 and 418).

Consistent with the above description, then, at least three different approaches may be used to obtain, and/or to combine, conduction voltage samples Vcs from any or all of the elements of a matrix, depending upon the needs of a particular design. In a first approach, which may be termed non-concurrent sampling, each column connection to be sensed may be switchably connectable to a sample device, which may be shared by all such "sensible" columns. In non-concurrent sampling, a conduction voltage is sampled for a single selected device at any one time, typically during a scan cycle conduction period, and the sample device is then connected to the hold element during a non-conduction period. Such sampling may be performed during successive scan cycles, so that previously sampled voltages are combined with the most recently sampled voltage to produce the hold voltage Vh on the hold capacitor. The extent of averaging will, of course, be a function of the relative size of the sample capacitor 410 and the hold capacitor 430. If the sample device performs digital sampling, or digital values are derived, then the combining function may be programmably controlled and great flexibility is possible. For example, combined values from any selected groups of pixels may be used to control the precharge voltage.

A second approach to obtain and combine conduction voltage samples Vcs may be called parallel sampling. Each column connection which is able to be sensed may be connected by a sample switch, such as 442, to a unique corresponding sample capacitor, such as 440. In this approach, the outputs from various sample devices, such as the sample circuits 356 and 366, are connected to a shared hold device, such as the hold device 312. There may be one or more separate hold devices like 312, each connected in turn to one or more sample devices, and each providing a precharge voltage reference to a buffer such as 310, the output of which provides precharge voltage to one or more column connections, such as 358 and 368. Thus, this approach can readily provide a number of different precharge voltages for distinct column groups. In a limiting case for this arrangement, all of the sample circuits (e.g., 366) for all of the sensed columns are connected via corresponding sample output switches (e.g., the switch 444) to a single hold device (e.g., 312). The hold device thereby provides a single hold voltage Vh to a buffer (e.g., 310) as a reference for a precharge voltage.

A third approach to obtain and combine conduction voltage samples Vcs may be called mixed sampling. The mixed sampling approach can also provide one or more precharge voltages Vpc for one or more corresponding groups of columns, as does the second or parallel sampling approach. According to the third approach, a number of columns, such as Column X, Column Y and the column connection 358, is each switchably connected to a shared sample device, e.g. 356, via sample switches such as 412, 416 or 418. It will typically be inconvenient to connect different active columns together, which may be avoided by ensuring that only one of such common-capacitor sample switches is closed at any given instant. For example, just one of the columns may be connected during a particular conduction period. Different columns may alternatively be connected to the sample capacitor at different times during a scan conduction period, particularly if the sample capacitor (e.g., 410) is connected to the hold circuit (e.g., via the switch 414) while all columns are disconnected. Such shared sample devices (e.g. 356) are typically connected via a corresponding sample output switch, such as 414, to a common hold device, such as 312, or to a digital conversion circuit. One or more sample circuits, whether shared like the sample circuit 356, or unique to a column like the sample circuit 366, may be connected to a common hold device, such as 312, such that the held value can reflect the column voltages sampled by such one or more sample devices. A driver device, e.g. 300, may have just one such hold device to provide Vh for controlling Vpr for all columns, or it may include a number of such hold devices. If more than one hold devices is used, then each hold device may control a Vpr for a corresponding group of columns. Voltage values from a number of hold devices may also be further combined. For example, several hold device voltages may be combined into a further combination stage (not shown), or after digital conversion they may be combined programmatically.

The hold voltage Vh, which is used to establish the next precharge voltage, may be filtered. Vh may be based only on combinations of presently sampled Vcs values, but will more typically combine Vcs values from previous scan cycles to form a smoothed precharge voltage. In digital embodiments, Vh may be filtered digitally to reflect any combination of Vcs samples from present and past scan cycles. In the analog embodiments represented in FIG. 4, filtering may be controlled by the number of sample device outputs combined into a particular hold device. For example, if four sample devices like 356, each having a sample capacitor like 410 of the same value, are connected into a hold device having a hold capacitor 430, then filtering generally occurs as a well-known averaging function of the relative capacitor values. In one embodiment, each sample device includes a second phase switch, such as the switch 414 or the switch 444, and all of the second phase switches are closed during a non-conduction period of the sampled elements. Accordingly, the resulting hold voltage Vh will be determined by the previous Vh value in combination with an average, Vcsa, of the four sampled Vcs values. Given a sum of all the sample and hold capacitor values Csum, including a sum of the sample capacitors Csamp and a hold capacitor value Chold, the new Vh (Vh(z+1)) will be the old Vh (Vh(z)) combined with Vcsa. In particular, $$Vh(z+1)=Vh(z)[Chold/Csum]+Vcsa[Csamp/Csum] \quad \text{Eqn. 1}$$

Thus, in this case a proportion Chold/Csum of the new Vh is due to the old Vh, and a proportion Csamp/Csum of the new Vh is due to the present Vcsa. If Csamp/Csum is more than about 25%, Vh will substantially track the recent Vcsa, and thus the precharge voltage will substantially track changes in the precharge voltage due to the varying column resistance seen by the different rows. Conversely, if Csamp/Csum is substantially smaller than 25%, the present Vcs will have less effect on the next Vh, and the precharge voltage will be less able to follow changes in Vcs from row to row. For long term averaging, Chold may be about 20 to 200 times Csamp. For rapid tracking, Chold may be about 0.3 to 3 times Csamp. Values between or outside these ranges may also be used, depending upon the application.

As an example, if four sample devices each having a sample capacitor of a value 1 pF are combined into a hold device having a hold capacitor of 8 pF, the next Vh would be based 33% upon the present average of Vcs values, and the precharge voltage would substantially track progressive changes in conduction voltages from row to row.

In order to individually control a quantity of charge delivered to each device in a matrix, an exposure period (see 560 of FIG. 5) of variable duration may be provided for each column during each scan cycle. The devices shown in FIG. 4 to control such variable exposure durations are generally, but not necessarily, fabricated as part of the driver device 300.

A precharge signal PC 494 may be provided to reset a counter 490 during a precharge period prior to an exposure period. Upon termination of the precharge period, the PC signal 494 may set a latch 478 such that an output "Column Enable" 488 enables a switch 404 to provided column exposure current to the column connection 358 from the current source 350. The signal PC (precharge timing) 494 may be provided for the entire chip, or may be established for a group of one or more columns.

In order to control the termination of exposure current, exposure duration information may cause reset of the latch 478. An exposure clock Cexp 492 may be provided, the period of which determines the minimum exposure period. A counter 490 may count the exposure clock edges and output n+1 bits representing a current exposure count 496 to some or all of the column drive circuits. The n+1 bits of exposure count 496 may be provided to all columns, or alternatively some columns may generate separate exposure counts. Particularly when provided to many or all columns, such exposure count need not be uniform, but may provide a varying time between successive exposure counts to provide varying steps between exposure levels without a need for excessive data bits to represent such exposure levels. The exposure count 496 may be applied to input "A" of a logic circuit 480.

N+1 bits of exposure drive data Ddrive 498 may be provided for the particular column, e.g., 358, to a register 470. The Ddrive data 498 may be provided serially and shifted into a shift register 470, or may be provided on a parallel bus and be latched into the register 470 under control of a write clock Cwrite 472. The output 474 of the register 470 may be n+1 bits of parallel exposure length data, which may then be provided to input "B" of the logic circuit 480. The logic circuit 480 may compare the exposure length data 474 on input "B" with the current exposure count value 496 on input "A" and provide an output 482 which, when A and B are equal, resets the latch 478. The "Column Enable" signal 488 is thus negated, and will cause the exposure current switch 404 to open and also, typically, will initiate discharge of the controlled column (e.g., 358) through discharge circuitry such as a column discharge switch 406.

An output 420 of an AND gate 486 may be the signal Φ1*a* 420 to control the sample switch 412. A logic device 481 may provide further logic for controlling the signal Φ1*a* 420. It may be employed to preclude sampling a Vcol for a column which has a conduction period shorter than the minimum exposure value 476, for example by preventing connection of a Vcol to a sample capacitor until the end of the minimum exposure period, thus permitting some settling of Vcol as discussed below with respect to FIG. 5. To effect this, the value of minimum exposure for sampling 476, typically represented by less than (n+1) bits, may be provided to a "C" input of the device 481 such that an output 484 is true only when the Exposure Count value 496 on input "A" is at least as great as the input "C." Signal Φ1*a* 420 may be prevented, until such time, from causing the column 358 to be connected to the sample device 356. The input "C" may be hardwired, or made selectable. Minimum sampling exposure may alternatively be controlled by a minimum exposure signal which is low until a selected period after the end of the precharge signal PC 494. Such a control line may be provided directly to a number of column control circuits, and may be connected to the input 484 of the AND gate 486 without any need for the logic device 481. In general, an almost unlimited variety of electronic device arrangements and logic may be employed to control a column drive device as taught herein.

The sample switch control output Φ1*a* 420 is true only if the column enable 488 is also true, as indicated by the AND gate 486 which provides Φ1*a* 420. The column enable output 488 from the flip-flop 478 controls the switch 404 which connects the current source 350 to the column connection 358, and thus directly controls the exposure time. The column enable 488 is set at the end of the precharge period, and is reset when the exposure count 496 "A" is equal to the selected exposure length "B."

Control for the column discharge switch 406 is not shown. The switch 406 is preferably closed after the end of the column enable 488, as long as the precharge switch 402 is not closed. In view of the substantial parasitic capacitance of the columns when the rows are connected to an AC ground, the actual termination of conduction by the matrix element may be controlled by the column discharge switch. In such case, the exposure switch 404 may be opened either somewhat before or somewhat after the discharge switch is closed, though typically the transitions will be nearly concurrent.

A selectable column sample group is a number of columns which are connectable to a shared sample device (such as the sample device 356) via a corresponding number of first phase switches (such as 412, 416 and 418). In the typical low-impedance circuits, such samples are typically separated by time. A single member of such selectable column sample group may be selected during a particular scan cycle, for example that column of the group which has the longest exposure time, i.e. the column for which the exposure length value (e.g. 474) is largest. Alternatively, however, differences in exposure times between selectable column sample group members may be utilized to permit sampling voltages from more than one of such selectable columns during a single exposure period. One implementation of this alternative selects, first, the shortest exposure length value which exceeds a minimum value. At the end of exposure for this first-selected column, its first phase switch may be opened and the second phase switch (e.g., 414) closed to the hold device 312. After sufficient settling time, the second phase switch 414 may be opened and another first phase switch closed to a column having an exposure time sufficiently long to permit establishing an accurate sample voltage on the sample device (e.g. 410). This time-multiplex process may be repeated several times during a scan cycle to average a number of different Vcs values using a single sample device. It may be performed as a variation of the first "non-concurrent" sampling approach, or as a variation of the third "mixed" sampling approach, both of which are discussed hereinabove.

Applying Precharge in Normal Operation

The stored value Vh on a hold device is used as a basis for precharging the parasitic capacitance of columns to a precharge voltage Vpr at the beginning of exposures, as shown in FIG. 4. In particular, Vh may be a reference input to a buffer, such as the buffer 310, which provides a precharge voltage Vpr at a reasonably low impedance to one or more columns, e.g. the columns 358 and 368 of FIG. 3. Vpr may be simply the value of Vh, or may be adjusted with an offset voltage (discussed further below) to provide an adjusted Vpr for the particular column or columns. For example, some elements will have more column and/or row resistance to the drivers than other elements. The different voltage losses due to the connection resistances may be measured or predicted, and based upon the selected current a Vpr difference due to such connection resistances may be calculated. Transient errors may also be anticipated, as discussed further below, and Vpr may then be adjusted to compensate for the anticipated conduction voltage differences and transient errors.

Figure 5:
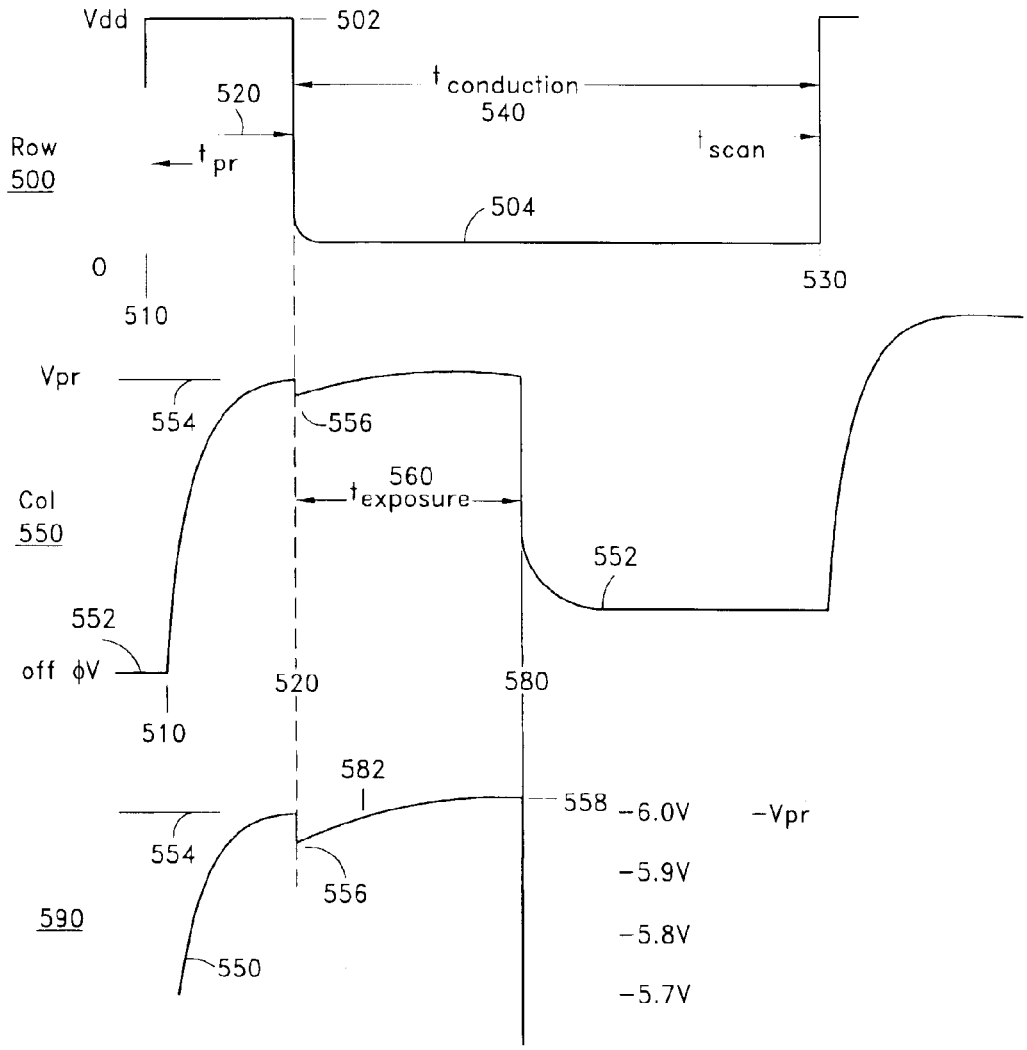
FIG. 5 is a representation of voltage values during a scan cycle.

FIG. 5 shows a representative voltage waveform 500 for a row, and a voltage waveform 550 for a column, during a single scan cycle. A voltage waveform 590 shows an expanded detail of the column voltage 550. The scan cycle begins at a time 510, when the row voltage (trace 500) is raised to a level 502, which is Vdd. A scan cycle may be divided into a precharge period 520, during which the row voltage 500 is high so that devices do not conduct, and a conduction period 540 when the row voltage is changed to conduction level 504.

Referring also to FIG. 3, the row switch 228 connects the Row K connection 388 to a voltage level 502, labeled Vdd, at a time 510 at the beginning of the scan cycle for the row K. Note that Vdd may be selected from a range of voltages depending upon application and present conduction voltages. Vdd may be selected to be slightly lower than Vpr if the voltage of the columns is limited so as to preclude significant conduction of matrix diode elements when the row is raised to Vdd. Vdd may also be somewhat higher than Vpr, so long as when the column voltage is dropped back to the off voltage 552 at a time 580, the reverse breakdown voltage of the diode elements is not exceeded. In one embodiment, Vdd is set to the same value as Vpr. Just before this period, the column voltage 550 is typically set to the column "off" voltage value of 552. This "off" value may be zero, near zero such as 100 mV or 200 mV due to driver voltage of the circuit elements forming the switch 352, or may be a different value which is preferably low enough to preclude significant conduction by the matrix element diodes when the rows of the elements are driven. Subject to these preliminary considerations, the scan cycle actually begins with a precharge period.

The precharge period is initiated, at time 510, when the column control switch 352 of the column driver device 300 switches the corresponding column connection 358 from the column "off" voltage source 354 to the precharge voltage source 314. Accordingly, the column voltage 550 rises from the "off" voltage 552 to the Vpr voltage 554. The exact waveform will vary from element to element, depending upon the drive circuit resistances and the total parasitic capacitance connected between the column connection 358 and any other point which has a low transient impedance to ground (such as the supply Vdd). The connection at switch 352 between the column 358 and the Vpr source connection 314 may be terminated any time after the column has achieved the desired precharge voltage. The waveform of the voltage 550 is expanded in a detail 590, showing the preferred condition when the voltage 550 of the column reaches Vpr 554 before the end of the precharge period. The end of the precharge period may be defined to coincide with a beginning of the conduction period 540 at time 520.

The precharge period, Tpr, preferably permits the column voltage 550 fully reach the selected precharge voltage, Vpr. The precharge period duration needed to achieve this condition depends upon several factors. First, each column has distributed parasitic capacitance and connection resistance which will affect the time required to achieve the full voltage on the driven element. Moreover, practical precharge supply buffers also have finite impedance. A column in a typical 96 row, 120 column device may have approximately an equivalent lumped column resistance of about 1 K ohms, and a lumped equivalent parasitic capacitance of about 2400 pF. The actual precharge time constant ($\tau$) in this case may be somewhat less than the 2.4 $\mu$S time constant which would be calculated for the column from the lumped equivalent values. To avoid significantly raising this time constant, the output impedance of the buffer 310 preferably does not raise the effective circuit resistance of the column by more than about 10%. Accordingly, the buffer impedance is preferably less than 100 ohms divided by the number of columns driven by the buffer. If a single Vpr buffer drives all columns of a 108-column display as described, then the buffer impedance is preferably less than 1 ohm. Generally, given a precharge time constant $\tau$, it is preferred to continue precharge for at least $3*\tau$, though shorter times may be used with some loss of accuracy or a need for compensation.

It should be noted that a single precharge voltage buffer, such as 310, may be used for many or all of the columns driven by the driver device 300, such that precharge buffer impedance becomes an important issue. In such case it is advantageous to provide a capacitor from Vpr to ground, the capacitor having a value of about one hundred or more times the parasitic capacitance of all of the driven columns.

After the precharge period, a conduction period ensues during which matrix devices may conduct. Each matrix device (e.g. the LED of the element 222) is intended to conduct during its specific exposure period (e.g. exposure period 560), which is typically only part of the conduction period 540. At the beginning of the exposure period 560 which begins at the time 520 (or before, while Vpr is connected), the switch 352 connects the column 358 to the current source 350. At the time 520 the row switch 228 connects the row connection 388 to a row drive voltage 504, e.g., ground, though finite switch impedance and currents flowing from all pixels will, in practice, cause the row line potential to be somewhat greater than the ground potential. Switching to a drive voltage is necessary to cause the device 222 to begin diode conduction, thus initiating light emissions or "exposure."

Switching the row voltage causes transient effects on the column voltage. The row voltage switch action applies a step input Vstep to the parasitic capacitance of the element 222. The size of Vstep will be the difference between Vdd (502) and row drive voltage (504). Charging the parasitic capacitance of the element 222 by Vstep will reduce the column voltage 550 to a value 556 which is reduced from Vpr (554) by Vnotch=Vstep/N, where N is the number of parasitic capacitors of the same size which are connected together to the column connection (e.g. 358) and which are also connected to the transient ground, as explained above. 96 rows were assumed in the example discussed above, and all are connected to the row "off" voltage (i.e., Vdd). For this typical case, N=96. Thus, if Vdd 502 is 6 V, and Vdrive 504 is 0 V, then Vnotch may be about 62.5 mV, and the column voltage 550 at 556 is about Vpr−Vnotch. Vnotch is increased when fewer rows are connected to the precharge buffer, that is, for smaller displays having a smaller N.

The column drive will typically be active for elements which are to be exposed during the conduction period. At the end of the precharge period at time 520, the column drive switches 352, 362 and 372 may switch each selected column connection (e.g. 358, 368 and/or 378) to the column current sources (e.g. 350, 360 and/or 370, respectively) for the remainder of an exposure period for the selected elements. Any or all of the elements (e.g. 222, 224, 226) of a scanned row (e.g. Row K) may generally be driven for an individually specifiable exposure period during the scan of that row.

If Vcol, initially driven to Vpr prior to an exposure, does not settle quickly to the steady state voltage for the driven current, then the average exposure current through the driven pixel is likely to be incorrect. For example, in FIG. 5 the column voltage 550 is rising during the exposure period 560 for the element 222 to a voltage 558 which is somewhat higher than Vpr, indicating that Vpr was not correct for the current driven through the pixel, and resulting in some error in the total current or charge conducted by the pixel during the exposure period. Correcting Vpr may correct such errors, and since subsequent values of Vpr will be based upon some combination of Vcs values, it is preferable that Vcs values are accurate. In order to obtain an accurate Vcs value when a Vcol is sampled, it will be helpful if the Vcol has reached steady state value.

As shown in FIG. 5, an exposure period 560 may be about 20 $\mu$S wide, and the current source 350 may be about 100 $\mu$A, which is able to drive a parasitic capacitance of about 2400 pF at 42 mV/$\mu$S. However, diode conduction limits the current available to drive the parasitic column capacitance, and accordingly the rate of charge is much slower near the final conduction voltage. Accordingly, as shown, the Vcol may not have settled to a steady-state value even at a time 580 when the exposure is terminated. In the illustrated situation in which Vcol is rising during exposure, the transient switching effects at the beginning of the exposure cause the value of Vcol 550 to be particularly incorrect prior to the time 582, as shown in the expanded trace 590. After the time 582, the column voltage 550 will tend toward the equilibrium value for the duration of the exposure period 560. Accordingly, samples taken later during the exposure period will, in general, more accurately reflect the equilibrium conduction voltage at the driven current.

Each individual active element may typically be turned off at a different time during the scan cycle of the element's row, permitting time-based control of the charge delivered during the scan cycle. For example, at time 580, the end of the intended exposure time for the element 222, the column connection 358 may be disconnected from the current source 350. However, the column capacitance may continue to provide current through the element if the row is still driven low. Therefore, in order to terminate current delivery the column may be reconnected to the column "off" voltage 354, so as to turn off the element. After this connection, the column voltage rapidly drops to the column "off" voltage 552.

After one element (e.g. 222) turns off, other elements (e.g. 224, 226) attached to the Row K connection 388 may continue to conduct as long as other columns (e.g. 368, 378) are driven and the row voltage 500 remains at the drive level 504. The conduction period ends when the row switch 228 in the scan circuit row driver 250 connects the row connection 388 back to the row "off" voltage Vdd, precluding further conduction by any elements. This switch may occur at the end of the scan cycle, which is the beginning of the next scan cycle precharge period, or it may be done at the end of the exposure time for the last conducting element of the scanned row.

Offsetting the Precharge Voltage

The voltage achieved across a current-driven device by applying a precharge voltage to a column connection may differ from that which is intended. When the precharge voltage Vpr is based upon previously measured element conduction voltages, it is typically intended that the voltage of the presently driven device match the voltage(s) of the device(s) upon which such previously measured voltages were based. At least two factors may interfere with such matching. The first factor includes transient errors, such as Vnotch, explained above with respect to FIG. 5. Incomplete charging of Vcol due to a short precharging period may be considered another transient error, and may lead to a further transient error when the current from the Vpr buffer (e.g. 310) is terminated while still at a relatively high level (particularly when the column voltage is below the final conduction level). Substantial charging current will cause a voltage drop across the column resistance between the column connection (e.g. 358) and the actual precharged element voltage stored on the distributed parasitic capacitance of the column. Accordingly, the actual element voltage will be lower than the voltage at the connection (e.g. 358), presumably Vpr. (Of course, if the charging current at the termination of the precharge period is equal to the conduction current, this "error" may precisely offset column voltage loss during exposure.) Second, in addition to transient errors, errors may be caused when the conduction voltages Vcs vary between the measurement condition and the precharge condition. Since the actual matrix device voltages often cannot be directly measured, the conduction voltages Vcol which are measured as Vcs include voltages which are largely independent of conduction by the element in question. Thus, for example, Vcol may vary due to varying cumulative currents through common row and row driver impedances. To the extent that such non-device voltages vary between the Vcs upon which precharge is based, and the time when Vpr is delivered to the column, errors will be introduced to the voltage to which the element is driven.

Because Vpr is typically applied to Vcol only until the end of the precharge period, both transient errors and conduction voltage discrepancies may be compensated by changing the precharge voltage that is provided from the buffer 310. There are many possible means for providing such offsets, some of which are discussed further below. In a digital precharge circuit, in which the output of the precharge buffer (e.g. 310) is digitally controlled, the value of the precharge digital input number may be modified appropriately. An analog precharge control circuit, such as described with respect to FIG. 4, may be compensated by inserting an offset, which may be digitally adjustable, in series with the input of the buffer, e.g. 310.

Figure 6:
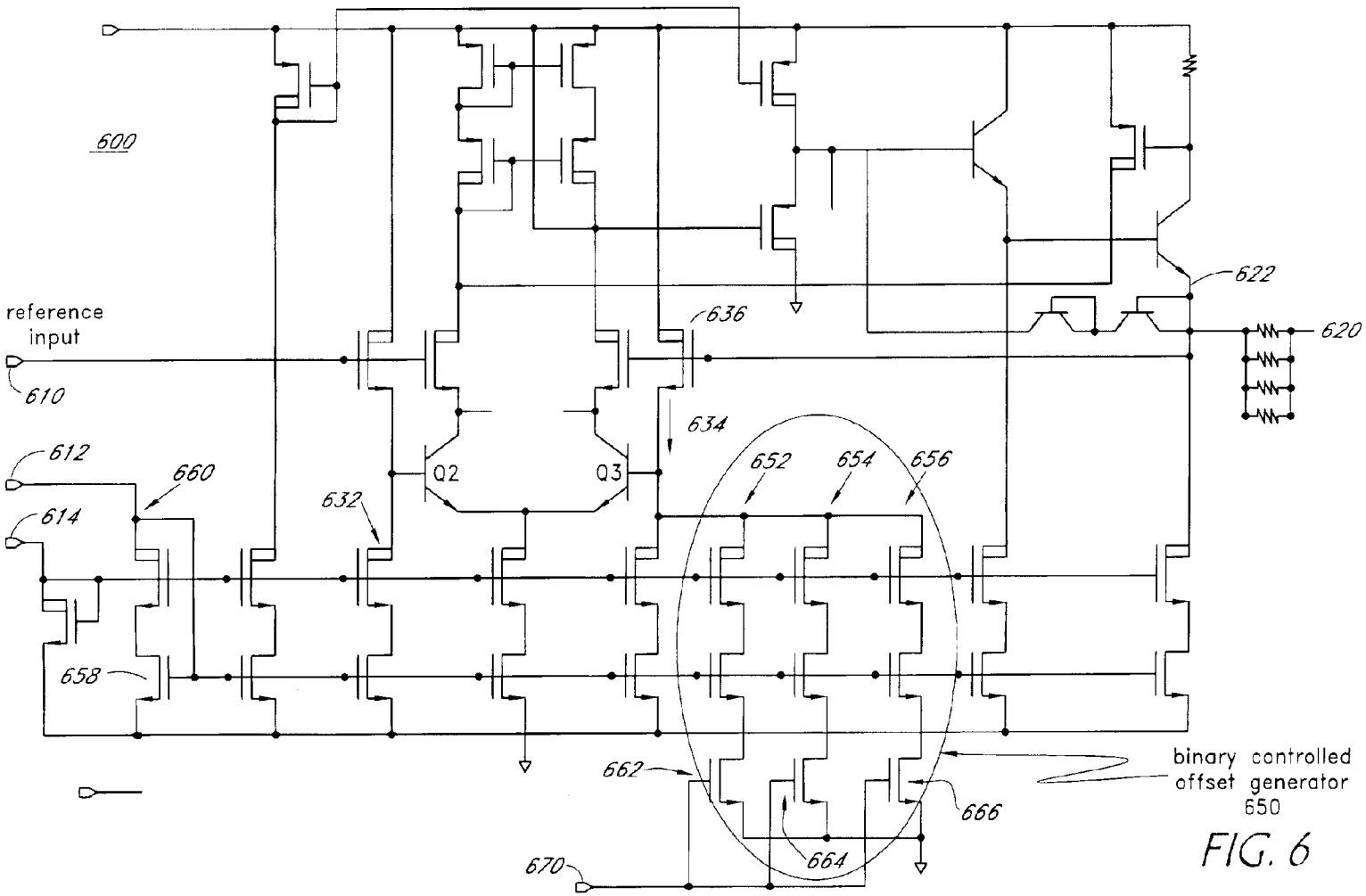
FIG. 6 is a schematic diagram of a precharge voltage buffer and offset circuit.

FIG. 6 shows an exemplary circuit for a Vpr buffer 600, such as the buffer 310, including a digitally adjustable offset circuit 650. The buffer 600 is generally a conventional design having a voltage input 610 connected to a first side of a differential amplifier stage. Current inputs 612 and 614 may be used as enables or to scale the drive currents. An output 620 is connected through a limiting resistor to the second side of the differential amplifier stage, 622. Any differences between current 632 through the first side differential input FET and current 634 through the second side differential input FET 636 will cause a difference between the voltages at 610 and 622, presuming the two differential input FETs as well as Q2 and Q3 are matched. Such current difference, divided by the input FET transconductance, establishes a difference in Vgs between the input FETs which establishes the difference between the voltage 622 and the voltage 610. Such a current difference may be established, for example, by means of a digitally controlled offset current circuit 650.

In the offset current circuit 650, current sources 652, 654 and 656 may be set, through size selection relative to the transistors in reference current mirrors 658 and 660, to have currents which are related to each other such that, for example, the current of the source 656 is twice that of the source 654, which is twice that of the source 652. The total current in that event, all sources conducting, is seven times the current in the source 652. Thus, the current in the source 652 should be set to be 1/7 as much as will cause the maximum offset desired, given the transconductance characteristics of the second differential FET 636. It should be noted that though the offset generator is designed to increase the voltage at the output 620 compared to the voltage at the input 610, the polarity may be shifted by placing, so as to increase the current 632, a current source similar (for example) to the source 656, or by many other techniques. A positive-only offset is shown to be unidirectional in order to compensate for the Vpr errors described above, which tend to cause Vcol at the beginning of the exposure to be low, but in other circuits Vpr errors may be reversed, such as when system polarities are reversed.

To control the offset generator 650, a data bit bus 670 having one bit for each of transistors 662, 664 and 666 may be provided. The least significant bit may control the transistor 662 which in turn enables the smallest current source 652, an intermediate bit may control a transistor 664 which enables the source 654, and a most significant bit may control a transistor 666 to enable the source 656. The number of sources and corresponding control transistors may be varied to provide more or less resolution on the offset value produced, and the current values need not be related as binary numerical values, but may for example set ranges of control if a largest current source, e.g. 656, is substantially more than twice the intermediate current source. The skilled person will understand that the ranging of such offset may be designed as a matter of engineering expedience, depending upon the offset ranges desired for the circuit.

Though an example of digitally controlled precharge voltages is described above, the skilled person will be able to design an unlimited number of different circuits for setting such voltage offsets, depending upon engineering and even aesthetic considerations, while remaining within the scope of the inventive ideas described above. For example, offsets may be disposed in different parts of the circuit, and need not be disposed at the input of a Vpr buffer (e.g. 310), but could be established, for example, in a sample circuit such as 356, or in a storage circuit such as 312.

Offsets to Vpr may also be used to compensate for other conduction voltages. For offset circuits which are digitally adjustable, such as the above-described circuit, a separate register may be provided to separately control each Vpr buffer circuit. This is particularly useful when significant differences in Vpr are needed for different groups of elements, such as those which are more or less distant from the row driver, e.g. 250, and consequently have more or less excess row conduction voltage due to different row resistance and common currents. For example, the element 226 in FIG. 3 may be connected to the row connection 388 by significantly more length of row connection than the element 212. Presuming there are many other elements between the near element 222 and the far element 226, and that in a particular scan cycle each of the elements is conducting, then there is a great deal of common current flowing in the resistance of Row K between the first and last elements 222 and 226. The resulting row voltage between the two elements will diminish the voltage delivered to the far element 226, but not the voltage delivered to the near element 222 (though the common voltage of the row connection, e.g. 388, will diminish both element voltages equally).

Such row voltage error can be compensated with circuits as shown in FIG. 6, if separate Vpr drive circuits are provided for near and far columns. A small current source may be provided for each column, or for each group of columns. The current may be calibrated to approximately represent a total voltage present at the cathode side of corresponding elements when such element (or group) is conducting by itself. If the row drive impedance presented at the row connection, e.g. 388, is not substantially resistive, then compensation therefore may be helpful. Thus, the current for near and far columns/groups will be linearly related between a minimum at the nearest column/group and a maximum at the farthest column/group.

The current may be enabled to flow into a common sensing line when the next exposure value for each column dictates that the column will conduct for at least a minimum portion, for example ¼, of the conduction period. Current sources for groups may be enabled, for example, when ¾ of columns in the group will be conducting ¼ or more of the conduction period. The exposure level selected to enable particular current sources may be adjusted in accordance with average exposure levels. The currents thus enabled may then be combined and converted to a digital value, proportional to the current, scaled to reflect the total row voltage caused at the farthest column or group by such conduction. Columns or groups of columns having a unique precharge voltage Vpr and offset voltage may be designated Vpr column groups. A digital row voltage value may be selected for each Vpr column group, calculated via a lookup table or calculation to be a certain proportion of the total row voltage. The proportion may be that proportion of the maximum row voltage which the average column of the Vpr column group has when all columns are conducting. While this will not be exact in all circumstances, it is adequate for most purposes. Precise calculations may be made by other means. Thus, a conduction offset value will be provided for each Vpr column group. The conduction offset value may be added to the offset value selected for the particular Vpr column group for all other purposes to create a group offset sum. The group offset sum may then be disposed in the offset compensation register which controls the offset compensation circuit of the particular Vpr column group in order to compensate the next precharge voltage.

It should be noted that if each Vpr is determined separately according to column voltage samples (Vcs) from columns within the corresponding Vpr column group, then row voltage compensation is not generally needed, since the individual Vcs will on average reflect the higher row voltage of the Vpr column group.

Alternatives and Extensions

While the above description has pointed out novel features of the invention as applied to various embodiments, the skilled person will understand that various omissions, substitutions, and changes in the form and details of the device or process illustrated may be made without departing from the scope of the invention. For example, those skilled in the art will understand that the orientation, polarity, and connections of devices in the display matrix is a matter of design convenience, and will be able to adapt the details described herein to a system having different devices, different polarities, or different row and column architectures. As another example, many different voltages may reflect (i.e., provide useable information about, or based upon) the conduction voltages sensed herein, or may reflect conduction voltages which the conduction voltages sensed herein are themselves reflecting. Any such different voltages may therefore provide a substantially equivalent basis for adjusting precharge values, and thus may be used for the purpose in alternative embodiments. All such alternative systems are implicitly described by extension from the description above, and are contemplated as alternative embodiments of the invention. Therefore, the scope of the invention is defined by the appended claims rather than by the foregoing description. All variations coming within the meaning and range of equivalency of the claims are embraced within their scope.

What is claimed is:

1. An apparatus for providing a precharge for display elements, comprising:

a current source configured to provide a controlled current to a selected display element;

a sample circuit configured to obtain a display conduction voltage sample which substantially reflects an output voltage caused by conduction of the controlled current at least partly through the selected display element;

a storage device to hold a representation of a reference voltage which is based on the display conduction voltage; and a precharge voltage source configured to output a voltage reflecting the reference representation of output voltage as offset by a quantity selected to compensate for expected transient voltage effects.

2. The apparatus of claim 1, further comprising:

a converter configured to produce a digital representation of the sampled display conduction voltage; and a digital controller configured to store such digital representation, to add thereto a digital value reflecting the selected offset, and to store the reference voltage represented thereby.

3. The apparatus of claim 1, wherein the precharge voltage source is configured to provide an output controllably offset from the input accepting the stored reference voltage.

4. The apparatus of claim 1, further comprising a digitally controllable offset circuit for the precharge voltage.

5. The apparatus of claim 4, wherein the offset circuit is included in the precharge voltage source.

6. The apparatus of claim 4, wherein the offset circuit includes a plurality of digitally enabled current sources connected to drive current to one side of a differential amplifier circuit.

7. An apparatus for driving conduction lines connected to matrix elements to a precharge voltage level, the apparatus comprising:

a current source switchably connected to a conduction line during a conduction period of a matrix element;

a voltage sampling circuit configured to sample a voltage of the conduction line during the conduction period;

a combining circuit configured to determine a conduction line voltage level from a combination of one or more conduction line voltage samples;

a precharge basis storage circuit configured to obtain a precharge basis which is based upon the determined conduction line voltage level, and to store a representation of the precharge basis;

a precharge voltage source configured to provide a precharge voltage based upon the stored representation of precharge basis;

an offset circuit configured to offset the precharge voltage from the determined conduction line voltage level; and a switch controllable to connect the provided precharge voltage to an element conduction line during a precharge period.

8. The apparatus of claim 7, wherein the conduction cycle of the element is preceded by a precharge period and is part of an operational scan cycle.

9. The apparatus of claim 8, wherein the offset circuit includes a digital control input.

10. The apparatus of claim 9, wherein the precharge voltage source further comprises a differential amplifier with a binary data offset control input.

11. The apparatus of claim 10, wherein the precharge voltage source further comprises a plurality of current sources enabled by binary data.

12. A device for providing a precharge for elements in a matrix, comprising:

a plurality of controlled level current sources which are switchably connectable to a corresponding plurality of column connections;

a sample circuit configured to obtain a column connection voltage sample while the corresponding current source is connected to the column connection;

a storage device configured to store a reference voltage based at least in part on the column connection voltage sample; and a precharge voltage source connectable during a precharge period to at least one column connection to provide a precharge voltage which is offset from the reference voltage by a predetermined compensation voltage.

13. The device of claim 12, further comprising a circuit to selectably vary the compensation voltage.

14. The device of claim 12, further comprising a circuit configured to vary the compensation voltage in accordance with one or more digital bits.

15. The device of claim 12, wherein the precharge voltage source further includes a differential amplifier.

16. The device of claim 15, further comprising a circuit configured to provide controllable current to one side of the differential amplifier.

17. The device of claim 12, further comprising a circuit to prevent sampling a column voltage during a predetermined minimum time after a beginning of a conduction drive period for the column connection.

18. An apparatus for providing a precharge for display elements, comprising:

means for providing a known current to a selected display element;

means for obtaining a display conduction voltage which is caused by conduction of the known current at least partly by the selected display element;

means for storing a reference voltage which is based on the display conduction voltage; and means for outputting a precharge voltage substantially equal to the reference voltage as offset by an amount which is selected to compensate for differences between the output precharge voltage and the display conduction voltage which are expected due to connection changes associated with changing from a precharge state to a conduction state.

19. The apparatus of claim 18, wherein the means for outputting a precharge voltage includes a buffer amplifier circuit having means for selectably varying an offset voltage between a reference input to the buffer amplifier circuit and an output from the buffer amplifier circuit.

20. The apparatus of claim 19, wherein the means for selectably varying an offset voltage includes means for control in accordance with a plurality of data bits.

21. The apparatus of claim 19, wherein the means for selectably varying an offset voltage includes means for selectably controlling current into one of two differential sides of the buffer amplifier.

22. The apparatus of claim 18, further comprising means for controlling durations for the provision of the known current to the selected display element so as to substantially control a quantity of charge conducted by the selected display element during a row scan cycle.

23. The apparatus of claim 18, further comprising means for sampling a plurality of matrix conduction voltages.

24. The apparatus of claim 23, further comprising means for combining the plurality of matrix conduction voltages to forma a basis for the reference voltage.

25. A method for establishing a precharge voltage for current-driven device elements in a matrix, the method comprising:

selecting an element for sampling;

driving a controlled current from a current source into a connection to the selected element via a current drive path;

producing a conduction voltage sample by sampling a voltage which substantially reflects a voltage caused by the selected element conducting at least part of the controlled current;

generating an offset voltage to compensate for perturbations to a delivered voltage which are expected for a subsequently driven element;

combining the offset voltage with one or more conduction voltage samples to obtain an adjusted precharge voltage level;

generating a precharge voltage source output substantially at the adjusted precharge voltage level; and precharging the subsequently driven element from the precharge voltage source during a precharge period.

26. The method of claim 25, wherein the step of generating an offset voltage includes selecting the offset from within a controllable range of offset voltages.

27. The method of claim 26, further comprising selecting the offset voltage by setting binary data bits which control an amount of the offset voltage.

28. The method of claim 25, wherein the selected current is driven through the selected element during an exposure period of a normal scan cycle.

29. The method of claim 25, further comprising:

deriving a previous conduction voltage reference from the one or more conduction voltage samples; and offsetting the previous conduction voltage reference with the offset voltage to obtain the adjusted precharge voltage level.

30. The method of claim 29, further comprising:

sampling conduction voltages for selected elements during ordinary scan periods; and combining conduction voltage samples from a plurality of different scan cycles to derive the previous conduction voltage reference.

31. The method of claim 29, further comprising:

selecting a plurality of different elements;

sampling a conduction voltage of each of the plurality of different elements during one scan cycle to obtain a plurality of conduction voltage samples; and averaging the plurality of conduction voltage samples to form a scan conduction voltage value.

32. The method of claim 29, wherein generating the precharge voltage source output includes providing the previous conduction voltage reference as an input to a voltage buffer having a differential amplifier circuit to control an output of the buffer.

33. The method of claim 32, further comprising switching an offset current source to provide current to one side of the differential circuit whereby the buffer output voltage is offset from the previous conduction voltage reference input to the buffer.

34. The method of claim 33, wherein switching the offset current source further comprises switching each of a plurality of switchable current sources with a corresponding binary data bit, and summing current from the plurality of switchable current sources to form the offset current.

35. A method for adjusting a precharge voltage for current-driven device elements in a matrix, the method comprising:

selecting an element for sampling;

applying the precharge voltage to a connection to the element during a precharge period of a scan cycle;

driving a selected current from a current source to the connection to the element during a current conduction period of the scan cycle;

sampling a conduction voltage during the current conduction period of the scan cycle;

adjusting the precharge voltage based at least in part on the sampled conduction voltage.

36. The method of claim 35, further comprising:

selecting an offset voltage to compensate for expected differences between sampled conduction voltages and a precharge voltage needed to cause a correct voltage to be developed on a subsequently driven element at a beginning of a conduction period therefor; and combining the selected offset voltage with one or more sampled conduction voltages to control an adjusted precharge voltage.

37. The method of claim 36, further comprising setting a plurality of binary data bits to select the offset voltage.

38. The method of claim 37, further comprising:

deriving a reference voltage from a plurality of sampled conduction voltages, and offsetting the reference voltage with the selected offset to determine the voltage output from a precharge buffer.

39. A method of manufacturing an electronic display device, comprising:

obtaining a matrix device column driver configured to sample a voltage of a column drive output during a conduction period of an exposure cycle to obtain an exposure conduction sample voltage, and provide, to a column drive output, a precharge voltage which is offset from a precharge voltage basis derived in part from the exposure conduction sample voltage, the offset being selected to compensate for expected deviations between a delivered precharge voltage and a voltage of a column drive output following termination of the precharge voltage provision;

connecting a plurality of column drive outputs of the matrix device column driver to corresponding column connections of a luminescent display; and connecting a plurality of row connections of the luminescent display to a corresponding plurality of row drive outputs of an electronic row driver device which is configured to selectively connect one of the plurality of row drive outputs to a row drive voltage during the exposure time of the matrix device column driver.

40. The method of making of claim 39, wherein the row driver and the column driver are fabricated on different semiconductor substrates.

41. The method of making of claim 39, wherein:

the matrix device column driver further includes a converter configured to produce a digital representation of the exposure conduction sample voltage; and the method of making the electronic display device further includes incorporating a digital controller configured to store the digital representation of the exposure conduction voltage, to add thereto a digital value reflecting the selected offset to create a reference voltage, and to store the reference voltage.

42. The method of making of claim 39, wherein the precharge voltage source of the matrix device column driver further includes an output which is controllably offset from an input which accepts a stored reference voltage.

43. The method of making of claim 42, wherein the precharge voltage source output offset from the input is controlled by a digitally controllable offset circuit.

44. The method of making of claim 43, wherein the offset circuit is included in a precharge voltage source buffer.

45. The method of making of claim 44, wherein the offset circuit includes a plurality of digitally enabled current sources connected so as to drive current to one side of a differential amplifier circuit.

46. A method of manufacturing a device for driving a multiplicity of output conduction lines when they are connected to matrix display elements, the method comprising:

switchably connecting a corresponding electronic current source to each of the output conduction lines;

emplacing control logic devices to selectably connect one of the current sources to its corresponding output conduction line during a conduction period;

disposing a voltage sampling circuit in the device which is configured to sample a voltage of the conduction line during the conduction period;

connecting a combining circuit to the device configured to determine a basis for a precharge voltage from a combination of one or more conduction line voltage samples;

incorporating a controllable offset circuit in the device; and providing a precharge voltage source buffer in the device configured to produce a precharge voltage which is offset from the precharge voltage basis in accordance with an offset from the offset circuit.

47. The method of making of claim 46, further comprising incorporating timing control elements, and configuring the timing control elements to control the outputs of the device throughout a sequence of operational scan cycles, such that during each scan cycle the precharge voltage is applied to active outputs during a precharge period, and a current from the corresponding current source is applied to the active outputs for a controllable portion of an exposure period following the precharge period.

48. The method of claim 46, further comprising including a digital control input to the offset circuit.

49. The method of claim 46, further comprising incorporating a differential amplifier with a binary data offset control input within the precharge voltage source buffer.

50. The method of claim 49, wherein the binary data offset control input is configured to control a plurality of current sources within the precharge voltage source buffer.

51. A method for establishing a precharge voltage for current-driven device elements in a matrix, the method comprising:

driving a selected current from a current source to a selected matrix element via a current drive path;

generating a conduction voltage reference value reflecting a conduction voltage of the current drive path;

offsetting the conduction voltage reference value with a selected voltage offset value to compensate for expected differences between a delivered precharge voltage and a voltage occurring during subsequent conduction by the device element; and outputting a precharge voltage substantially at the offset conduction voltage reference value during a precharge period.

* * * * *